US009675119B2

(12) United States Patent
Alston

(10) Patent No.: US 9,675,119 B2
(45) Date of Patent: Jun. 13, 2017

(54) HOSIERY WITH FOOT CUSHIONS

(71) Applicant: Melanie Yvonne Alston, Phoenix, AZ (US)

(72) Inventor: Melanie Yvonne Alston, Phoenix, AZ (US)

(73) Assignee: Fushionz LLC, Phoenix, AZ (US)

( * ) Notice: Subject to any disclaimer, the term of this patent is extended or adjusted under 35 U.S.C. 154(b) by 0 days.

(21) Appl. No.: 14/185,993

(22) Filed: Feb. 21, 2014

(65) Prior Publication Data

US 2014/0230131 A1 Aug. 21, 2014

Related U.S. Application Data

(60) Provisional application No. 61/850,747, filed on Feb. 21, 2013.

(51) Int. Cl.
*A41B 11/00* (2006.01)

(52) U.S. Cl.
CPC ..... *A41B 11/007* (2013.01); *A41B 2400/32* (2013.01)

(58) Field of Classification Search
CPC ..... A41B 11/00; A41B 11/02; A41B 11/16; A41F 11/02; A41D 13/0518
USPC .... 2/239, 233, 409, 227, 215, 240–241, 267
See application file for complete search history.

(56) References Cited

U.S. PATENT DOCUMENTS 4,186,499 A * 2/1980 Massok, Jr. ..... A43B 17/102 139/420 R
4,651,354 A * 3/1987 Petrey ..... A41B 11/004 2/239
5,257,969 A * 11/1993 Mance ..... 602/28
5,402,540 A * 4/1995 Williams ..... 2/239
5,430,896 A * 7/1995 Bisley ..... 2/239
5,483,703 A * 1/1996 Williams ..... 2/239
5,596,770 A * 1/1997 Kunesh ..... 2/239
5,615,418 A * 4/1997 Pruit ..... 2/239
5,655,226 A * 8/1997 Williams ..... 2/239
5,675,992 A * 10/1997 Wrightenberry ..... 66/178 R
5,778,702 A * 7/1998 Wrightenberry ..... 66/178 R
5,832,539 A * 11/1998 Williams ..... A41B 11/005 12/142 G
6,108,820 A * 8/2000 Bernhardt ..... 2/239
6,275,997 B1 * 8/2001 Richardson ..... 2/239
6,446,267 B1 * 9/2002 Shah ..... 2/239
6,612,136 B2 * 9/2003 Roe ..... 66/178 R
7,213,420 B2 * 5/2007 Lynch et al. ..... 66/186
7,730,555 B2 * 6/2010 Hexels ..... 2/239
8,056,149 B2 * 11/2011 Duclos ..... A43B 19/00 2/239
8,205,271 B2 * 6/2012 Canci ..... 2/239
(Continued)

*Primary Examiner* — Clinton T Ostrup
*Assistant Examiner* — Bao-Thieu L Nguyen

(57) ABSTRACT

A hosiery product, such as a sock, footie, trouser sock or panty hose, includes and inner layer of hosiery material, such as nylon or spandex covering the bottom and top surfaces of the wearer's foot, and outer layer of similar hosiery material, and at least one cushion section disposed between the inner and outer layers. The cushion sections include an elevated cushioning material that conforms to the contours of the wearers foot, such as macro-gel activated support discs or memory foam. The ball of foot cushion sections are elevated attached circles, arch and heel cushions. All layers are attached.

10 Claims, 6 Drawing Sheets

(56) References Cited

U.S. PATENT DOCUMENTS

| | | | | |
|---|---|---|---|---|
| 8,745,893 | B2 * | 6/2014 | Gavrieli | A43B 3/248 36/102 |
| 2006/0195971 | A1 * | 9/2006 | Lambertz | 2/239 |
| 2006/0253961 | A1 * | 11/2006 | Chan | 2/239 |
| 2006/0253962 | A1 * | 11/2006 | Hua | 2/239 |
| 2010/0050320 | A1 * | 3/2010 | Canci | 2/239 |
| 2010/0050322 | A1 * | 3/2010 | Zagula | 2/239 |
| 2013/0205839 | A1 * | 8/2013 | Fukui | 66/185 |
| 2013/0333096 | A1 * | 12/2013 | Song | 2/239 |
| 2014/0059745 | A1 * | 3/2014 | Davis et al. | 2/409 |

* cited by examiner

Material Layer
fig.#2 (side view)
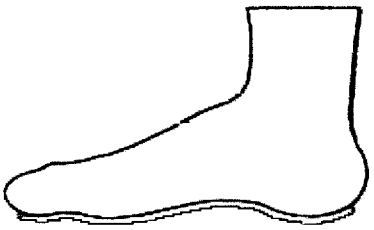
fig.#1 (bottom view)
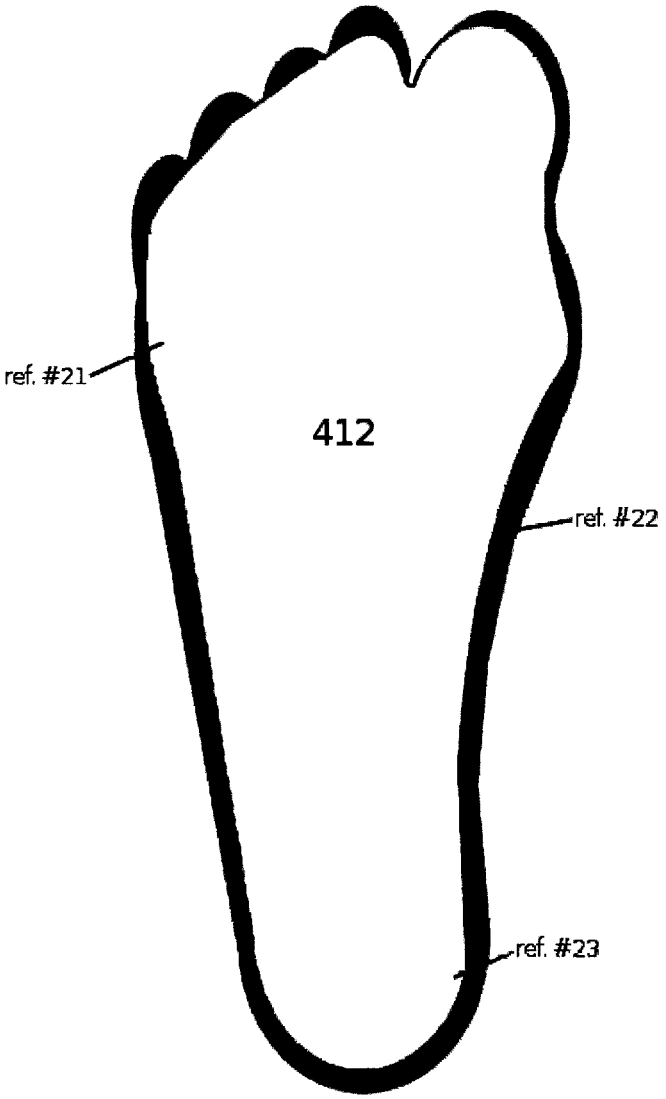

Support Layer
fig.#3 (bottom view)
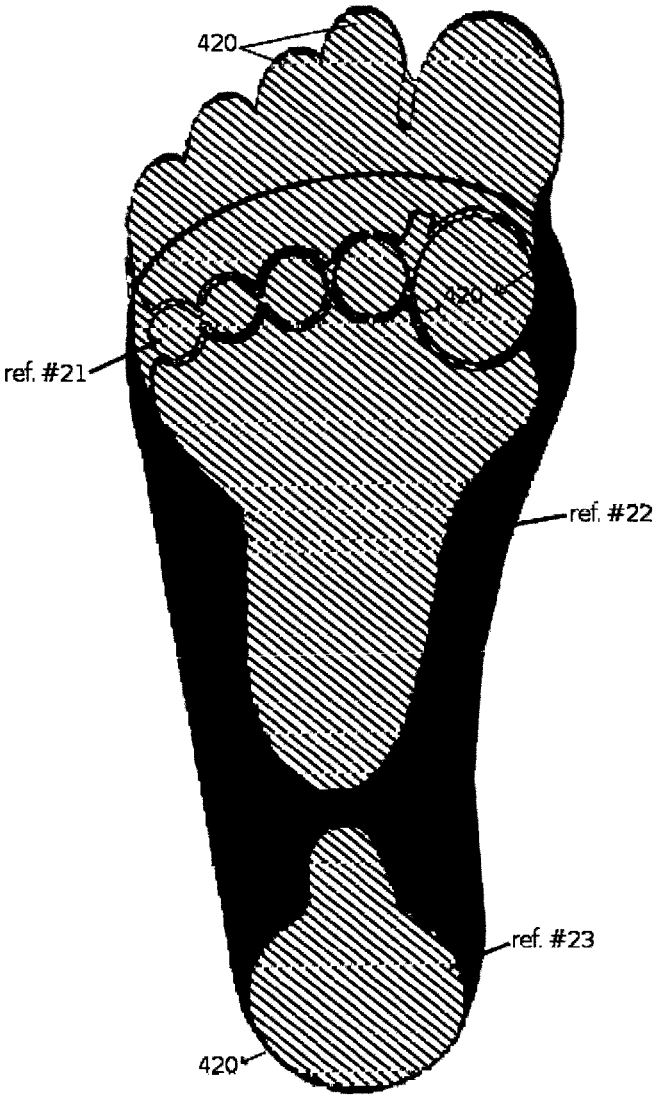
fig.#4 (side view)
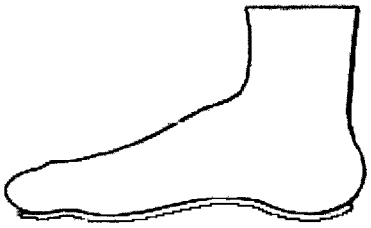

Padding Layer
fig.#5 (bottom view)
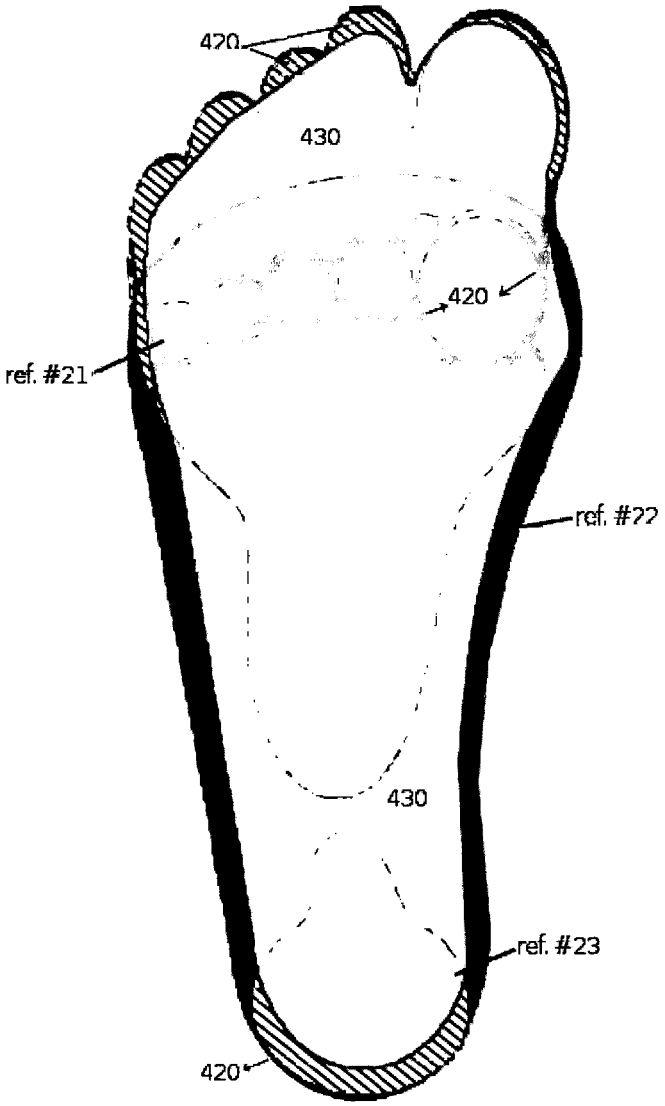
fig.#6 (side view)
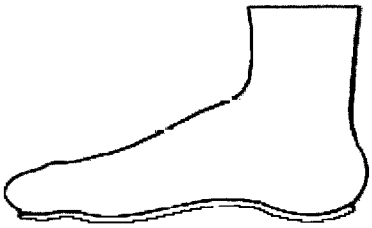

All Layers attached to Hosiery
fig.#7 (bottom view)
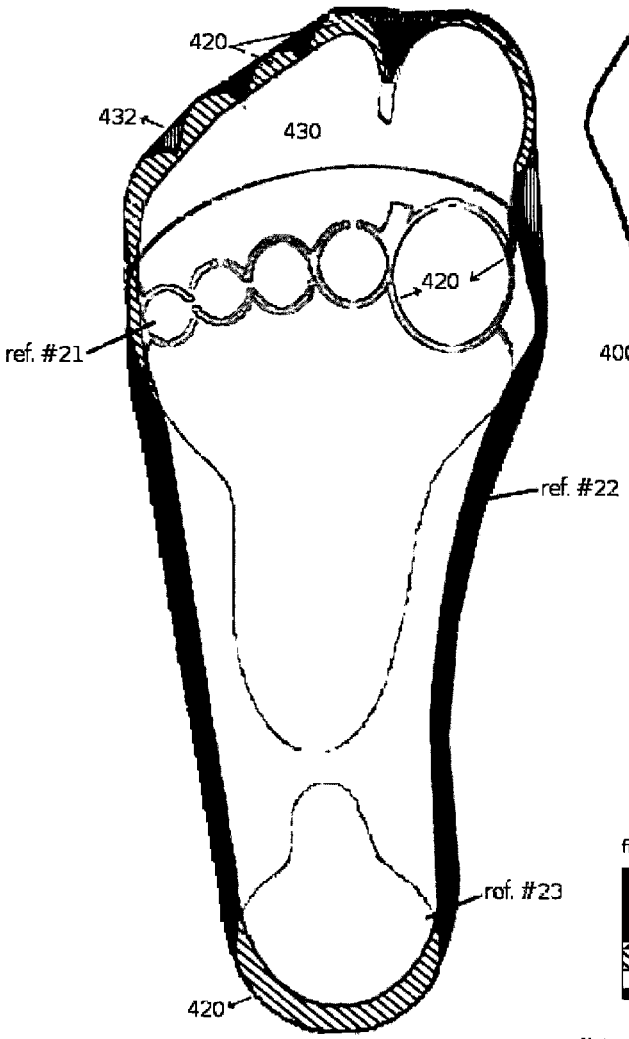
fig.#8 hosiery (side view)
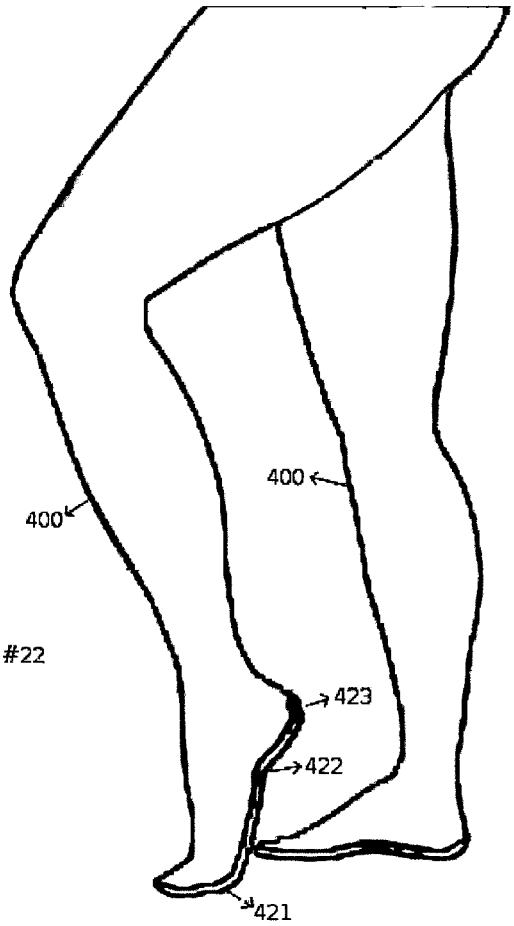
fig.#9 (close-up side view)
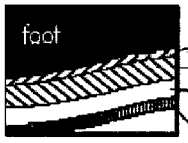
material layer (1)-412
support layer (2) -420
padding layer (3) -430
reinforced hosiery (4) -432
Note: #3 may not be needed in trouser socks, tights, footies, or hosiery if denier is higher Trouser Socks with support layer
fig.#10 (bottom view)
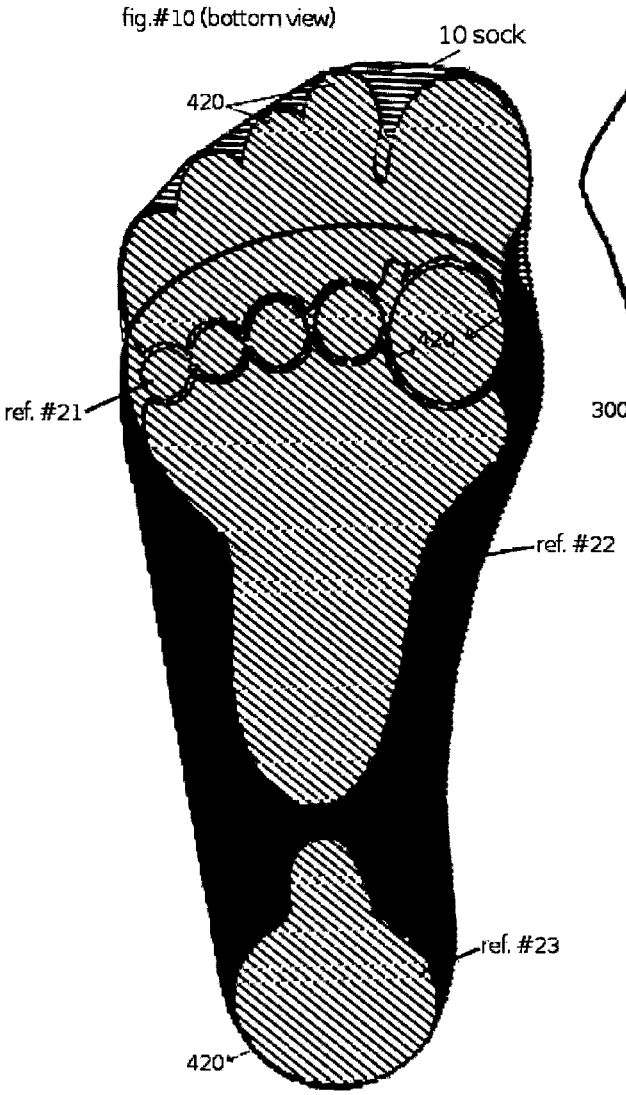
fig.#11 socks (side view)
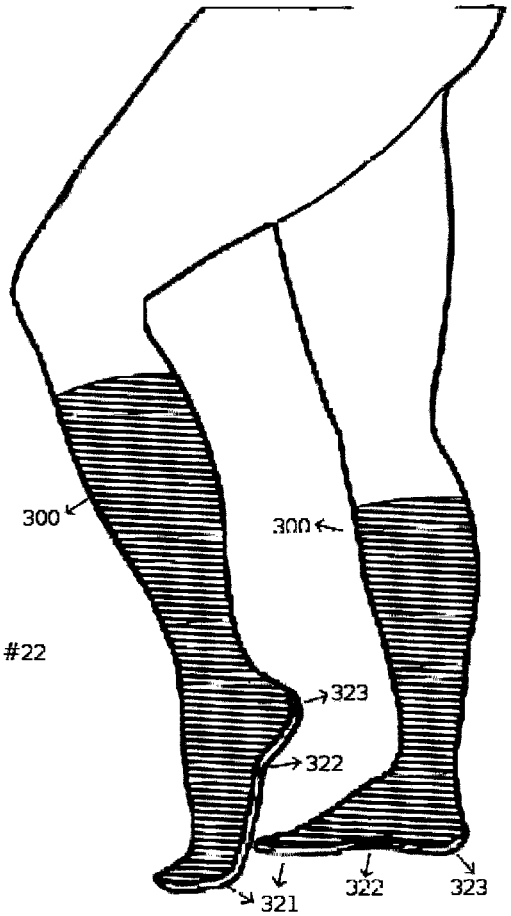

Footies and Cushion socks with support layer
fig.#12 (bottom view)
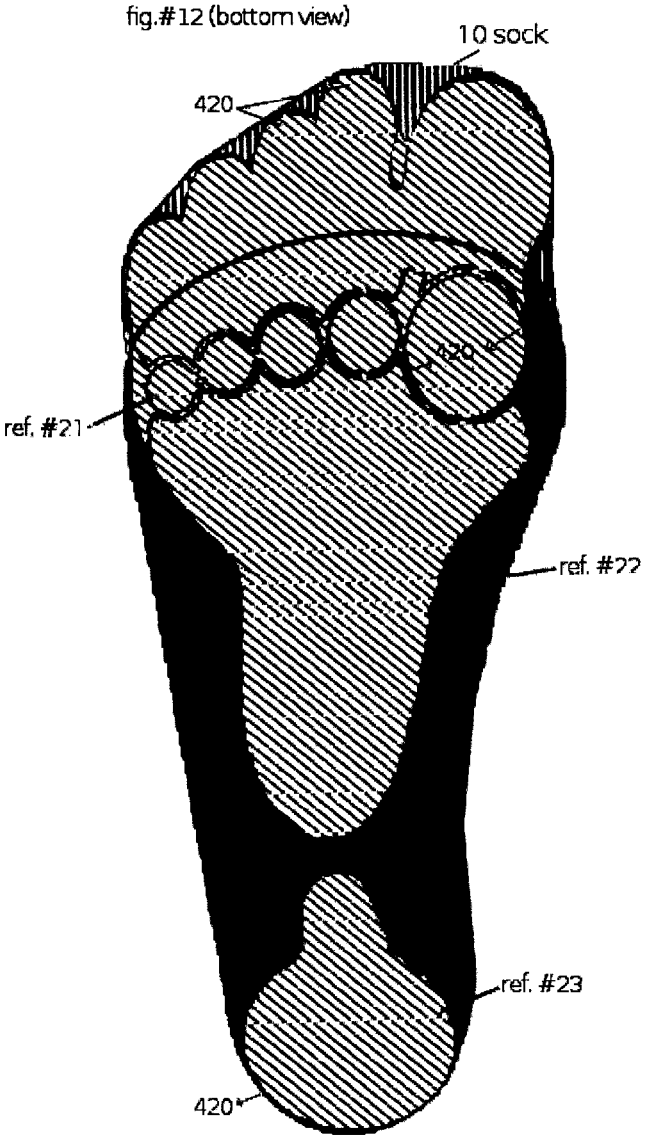
fig.#13 footies (side view)
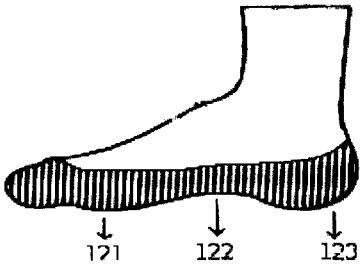
fig.#14 cushion socks (side view)
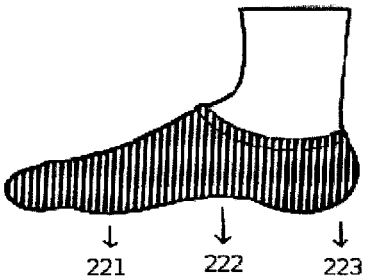

HOSIERY WITH FOOT CUSHIONS

CROSS-REFERENCE TO RELATED APPLICATIONS

This application claims priority to U.S. Provisional Patent Application No. 61/850,747 filed Feb. 21, 2013 which is incorporated herein by reference.

TECHNICAL FIELD AND BACKGROUND OF THE INVENTION

The present invention relates to hosiery products, such as panty hose, socks, and footies, trouser socks and knee highs. One embodiment of the invention comprises a hosiery product having sections of cushioning material providing support at particular areas of the bottom of the foot of the hosiery. One elevated cushion layer of material is placed on the arch and one elevated cushioning layer of material is placed on the heel and a plurality of elevated cushions are placed at the ball of foot, providing elevated support at particular areas of the bottom of the foot of the hosiery to alleviate the critical pressure points of the foot, such as the ball, arch and heel of the wearers foot. The plurality of elevated circles at the ball of foot are elevated.

Prior art hosiery includes Patent Application Publication No. 20120227161, which discloses hosiery having a built-in receptacle with an opening for receiving removable and disposable foot cushions. This hosiery device is relatively cumbersome and difficult to adjust rapidly.

There are cushion/support inserts that are to be positioned within a shoe. However, since such inserts are not attached to either the shoe or the wearer's sock, they can become easily dislodged from their desired position.

SUMMARY OF THE INVENTION

One object of the present invention is to provide a quick and easy, ready to wear hosiery product, such as a sock, panty hose, footie, knee high and trouser sock, having comfortable permanently stitched elevated support padding weaved or knitted directly in the bottom of the foot of the hosiery product. Another object of the invention is to provide a hosiery product with permanently attached support that conforms to a variety of foot sizes and minimizes wear and tear on the fabric. Another object of the invention is to provide a hosiery product that helps the wearer stand more comfortably on the pressure points of the foot, such as the ball of the foot, arch and heel.

Yet another object of the present invention is to provide a hosiery product having permanent sewn in padding and is simple and easy to put on and use. Yet another object of the present invention is to provide a hosiery product having permanently attached padding that easily conforms to any foot size. Yet another object of the invention is to provide a hosiery product that does not require a receptacle for interchanging and removal of padding sizes to fit the wearer's foot. Another object of the invention is to provide a hosiery product that does not increase the wear and tear on the hosiery by insertion and removal of pads into the fabric or an open receptacle. Yet another object of the invention is to provide a hosiery product that does not require selection of padding size, and does not require an assembly of parts by the wearer. Yet another object of the present invention is to provide variations of fabric and padding that will help the wearer's foot with coolness and warmness during the four seasons of the year.

These and other objects of the invention can be achieved in the preferred embodiments of the invention described below. One embodiment of the invention comprises a ready to wear, comfortable hosiery product, such as a footie, knee high, trouser sock or panty hose, having permanently stitched elevated support padding weaved or knitted directly in the bottom of the feet of the hosiery at the ball of foot, arch and heel that conforms to any wearers foot size and minimizes wear and tear on the fabric. This enables the wearer's ability to stand more comfortably on the critical pressure points of the foot such as the ball of the foot, arch and heel. The ball of foot cushion support is an elevated circle shaped support padding weaved or knitted directly in the bottom of the feet of the hosiery that conforms to any wearer's foot size. The hosiery is fabricated from materials suitable for hosiery and garment applications.

The hosiery product improves the wearer's ability to stand on the pressure points ball of foot, heel and arch in regular everyday heels, flats or clogs that are not padded properly for better comfort. The hosiery conforms to any wearer's foot size without interchanging or removal of foot pads. This provides wearer's a carefree alternative to foot comfort and support. The comfortable padding is a permanent part of the hosiery, and resolves issues with prior protective padding sliding out of place from wear and tear resulting from sliding the padding in and out of receptacles, which can deter the wearer from the ease of wanting to put on the hosiery. The cushioning and support material are permanently attached so as to conform to all wearer's foot sizes, providing needed elevated comfort and support to the areas of the balls, arch and heels of the feet for a more lasting comfortable feeling for the user. The padding targets the areas of the ball of foot, heel, arch metatarsal pressure point areas.

Different forms and density of memory foam, padding, or any other support material can be used to provide breathability, warmth or coolness to the feet. Different options can be used based upon the seasons of the year. The hosiery product utilizes high quality support fabrics and material of different densities to adapt to climatic conditions. For example, materials such as TEMPURPEDIC® foam can be used in the winter and ICLOUD® foam for the fall, summer and spring. Rather than the memory foam or other support materials being stitched, a stamping method could be used.

An embodiment of the invention comprises a hosiery product comprising an inner layer of hosiery material adapted to cover bottom and top surfaces of the wearer's foot, an outer layer of hosiery material adapted to cover bottom and top surfaces of a wearer's foot, and a plurality of ball of foot elevated cushion sections, shaped as a circle shape comprising a cushioning material disposed between the inner layer and outer layer at a position to cushion a particular area of the bottom surface of the wearer's foot. The cushion sections are permanently attached to the inner layer.

According to another embodiment of the invention, the cushion section is attached to the inner layer by sewing, stitching, knitting, weaving and/or stamping.

According to another embodiment of the invention, the cushion sections are positioned to cushion a particular area of the bottom surface of the wearer's foot, such as the ball of foot, arch of the foot, heel of the foot.

According to another embodiment of the invention, the cushioning material comprises a material that adapts to contours of the wearer's foot.

According to another embodiment of the invention, the cushioning material is comprised of viscoelastic support gel, macro-gel activated support discs, memory foam, gel memory foam, and/or latex foam.

According to another embodiment of the invention, the inner layer of hosiery material and the outer layer of hosiery material are comprised of nylon and/or spandex.

According to another embodiment of the invention, a reinforcing layer comprising a layer of hosiery material is positioned intermediate the cushion section and the outer layer to provide support to the cushion section.

According to another embodiment of the invention, the hosiery product can be a sock, cushion sock, trouser sock, footie, knee high or panty hose.

According to another embodiment of the invention, a hosiery product comprises an inner layer and outer layers of elastic material adapted to cover bottom and top surfaces of a wearer's foot, and a cushion layer comprising a cushioning material disposed between the inner layer and outer layer at a position to cushion the bottom surface of the wearer's foot.

According to another embodiment of the invention, the cushion layer comprises a plurality of cushion sections, and each elevated cushion section is positioned and shaped to cushion a particular area of the bottom surface of the wearer's foot. The five ball of foot cushions are pinpointed, attached, elevated and circle shaped to cushion a particular area of the bottom surface of the wearer's foot.

According to another embodiment of the invention, the plurality of cushion sections comprises a first attached elevated cushion section of five ball of foot shaped cushion section positioned to cushion the metatarsals region of the wearer's foot, a second elevated cushion section positioned to cushion the arch region of the wearer's foot, and a third elevated cushion section positioned to cushion the heel region of the wearer's foot.

According to another embodiment of the invention, the plurality of elevated cushion sections are permanently attached to the inner layer.

According to another embodiment of the invention, the plurality of cushion sections are attached to the inner layer by sewing, stitching, knitting, weaving and stamping.

According to another embodiment of the invention, the cushioning material comprises a material that adapts to contours of the wearer's foot.

According to another embodiment of the invention, the cushioning is selected from the group consisting of viscoelastic support gel, macro-gel activated support discs, memory foam, gel memory foam and latex foam.

According to another embodiment of the invention, a reinforcing layer of breathable nylon is positioned intermediate the plurality of elevated cushion sections and the outer layer, and provides support to the plurality of elevated cushion sections.

A hosiery product according to another embodiment of the invention comprises inner and outer layers of hosiery material adapted to cover bottom and top surfaces of the wearer's foot, and at least one cushion section comprising a cushioning material that conforms to the contours of the wearers's foot. The elevated cushion section is disposed between the inner layer and outer layer at a position to cushion a particular area of the bottom surface of the wearer's foot, and the cushion section is integrally attached to the inner layer or outer layer.

BRIEF DESCRIPTION OF THE DRAWINGS

FIG. 1 is a bottom plan view of a sock material layer according to a preferred embodiment of the invention;

FIG. 2 is a side view;

FIG. 3 is a bottom view of FIG. 1 with the support layer;

FIG. 4 is side view of FIG. 1;

FIG. 5 is a bottom view of a padding layer according to a preferred embodiment of the invention;

FIG. 6 is a side view of a cushion sock according to preferred embodiment of the invention;

FIG. 7 is a bottom view of all layers attached to hosiery;

FIG. 8 is a side perspective view of pantyhose according to the invention;

FIG. 9 is a close up side view of all layers attached of the panty hose of FIG. 7;

FIG. 10 is a bottom view of trouser socks with support layer,

FIG. 11 is a side view of trouser socks with support layer;

FIG. 12 is a bottom view of footies and cushion with support layer;

FIG. 13 is side view of footies with support layer and

FIG. 14 is a side view of cushion socks side view;

DETAILED DESCRIPTION OF PREFERRED EMBODIMENTS OF THE INVENTION AND BEST MODE

A hosiery product according to a preferred embodiment of the invention is illustrated in FIGS. 1-6 and shown generally at reference numeral 10. The hosiery product 10 can be a sock 10 comprised of an inner layer 412 an outer layer 432, and an elevated cushion layer at the ball of foot 420 positioned intermediate the inner layer 412 and outer layer 432. The cushion layer 420 comprises a plurality of sections 21, 22, 23.

The inner and outer layers 412, 432 are comprised of nylon or other elastic material suitable for hosiery, such as spandex. The cushion sections 21, 22, 23 comprise an elevated cushioning material capable of adapting to body contours. Preferably the cushioning material is comprised of a viscoelastic support gel, such as the macro-gel support discs sold by Serta, Inc. under the mark PODS or the gel sold by Serta, Inc. under the mark MICROSUPPORT. Preferably the cushioning material is substantially non-collapsible so that it does not collapse when supporting the weight of a person for extended periods of time. Alternatively, the cushion sections 21, 22, 23 can be comprised of viscoelastic polyurethane foam, known commonly as "memory foam". The cushion material can also be comprised of gel memory foam. Alternatively, the cushioning material can be comprised of latex foam, such as BIOH® Gel Latex sold by Cargill, Inc.

The elevated cushions sections 21, 22, 23 are encased by the inner and outer layers 412, 432, and permanently attached to the sock 10. The cushion sections 21, 22, 23 can be sewn to the inner layer 412 or attached by other suitable means such as knitting or weaving. Alternatively, the elevated cushion sections 21, 22, 23 can be attached using a stamping method. Each cushion section 21, 22, 23 can include a fabric pouch containing the elevated support gel, and the fabric pouch can be attached to the inner layer 412.

In an alternative embodiment, the elevated cushion sections 21, 22, 23 can be attached to the outer layer 432. In yet another alternative embodiment, the cushion sections 21, 22, 23 can be attached to both the inner layer 412 and outer layer 432.

The cushion sections 21, 22, 23 are positioned in the sock 10 to support the specific pressure points of the wearer's foot. As shown in FIG. 3, one cushion section 21 is shaped, elevated and positioned to cushion the ball of foot, metatarsals. The second elevated cushion section 22 is shaped, elevated and positioned to cushion the arch of the wearers foot, and the third elevated cushion section 23 is shaped and positioned to cushion the heel. As such, the cushion sections 21, 22, 23 provide elevated support and cushioning at the most critical and common areas of foot pain and pressure. The gel activated support material of the cushion sections 21, 22, 23 adapt to the contours of the wearer's foot.

The thin layer of the support materials adapted to the wearer's foot that extend to the extremity of the toes to provide comfort to the entire foot can be stopped at the bend of the toes.

The cushion sections 21, 22, 23 are completely and securely attached to the sock 10, such as by sewing, knitting or weaving. By so integrally attaching the cushion sections 21, 22, 23 to the sock 10, stray particles are prevented from entering and ruining the fabric of the sock 10, stray particles are prevented from entering and ruining the fabric of the sock 10. As such, the wear and tear on the fabric that is typically caused by removing and interchanging the padding in prior art devices is avoided by the sock 10. The cushioning sections 21, 22, 23 stay securely in place under the wearer's foot and easily adjusts for a wide range of climatic conditions.

The sock 10 can employed for general purpose and/or therapeutic applications. The sock 10 eliminates any need for a cushion/support insert typically positioned within a shoe. The cushioning material in the cushion sections 21, 22, 23 can be antimicrobial and/or hypoallergenic treated. In an alternative embodiment, the cushioning material can be inserted into a waterproof fabric and cut, weaved, stitched, knitted and placed into the sock.

As illustrated in FIGS. 1-14, the design and construction of sock 10 can be incorporated into other hosiery products. For example, FIG. 13 shows a footie 100 according to a preferred embodiment of the invention. The footie 100 has elevated cushion sections 121, 122, 123, and is identical in construction as the above described sock 10. FIG. 14 shows a cushion sock 200 according to a preferred embodiment of the invention.

The cushion sock 200 includes elevated cushion sections 221, 222, 223, as shown in FIG. 14 and is identical in construction as the above described sock 10. FIG. 11 shows trouser socks 300, 300 includes elevated cushion sections 321, 322, 323, respectively, and are identical in construction as the above described sock 10.

A hosiery product according to another preferred embodiment of the invention is illustrated in FIGS. 8-11, and shown generally at reference numeral 400. The hosiery product 400 comprises panty hose 400 comprising an inner material layer 412, a cushion support layer 420, a padding layer 430 and an outer reinforced layer 432. The cushion support layer 420 comprises a plurality of pinpointed elevated sphere or half shaped sphere cushions sections 421, 422, 423.

The inner and outer layers 412, 432, are comprised of a flexible, breathable material and/or an elastic material, such as nylon or spandex. The cushion sections 421, 422, 423 comprise a cushioning material capable of adapting to body contours. Preferably, the cushioning material is comprised of a viscoelastic support gel, such as the macro-gel support discs sold by Serta, Inc. under the mark PODS or the gel sold by Serta, Inc. under the mark MICROSUPPORT. Preferably, the cushioning material is substantially non-collapsible so that it does not collapse when supporting the weight of a person for extended periods of time. Alternatively, the cushion sections 21, 22, 23 can be comprised of visco elastic polyurethane foam, known commonly as "memory foam." Alternatively, the cushioning material can be comprised of latex foam, such as BIOH® Gel Latex sold by Cargill, Inc.

The reinforcing layer can be comprised of a hosiery material, such as breathable nylon, and provides additional strength to support the elevated cushion sections 421, 422, 423.

The padding layer 430 can be omitted if the outer reinforced layer 432 comprises a sturdy or dense material.

The cushion sections 421, 422, 423 are positioned intermediate the inner material layer 412 and the padding layer 430, and permanently attached to the panty hose 400. The cushions sections 421, 422, 423 can be sewn to the inner layer 412 or attached by other suitable means such as knitting or weaving.

The cushion sections 421, 422, 423, are positioned at the bottom of the feet of the panty hose 400 to support specific pressure points of the wearer's foot. As shown in FIGS. 7 and 8, one cushion section 420 is elevated, shaped and positioned to cushion the balls of foot metatarsals.

The second cushion section 422 is elevated, shaped and positioned to cushion the arch of the wearer's foot, and the third cushion section 423, is elevated, shaped and positioned to cushion the heel. As such the cushion sections 421, 422, 423 provide targeted elevated support and cushioning at the most critical areas of foot pain and pressure. The gel activated support material of the cushion sections 421, 422, 423 adapt to the contours of the wearer's foot.

The cushions sections 421, 422, 423 can have the following preferred dimensions. The layer of support gel in the cushion section 421 positioned below the ball of the foot preferably has a thickness of about one-fourth to three-eighths inch. The support gel in the cushion section 422 positioned below the arch of the foot preferably has a thickness of about one-fourth to three-eighths inch. The support gel in the cushion section 422 positioned below the arch of the foot preferably has a thickness of about one-fourth to three-eighths inch. The layer of support gel in the cushion section 423 positioned below the heel of the foot preferably has a thickness of about one-eighth to one-fourth inch.

The cushion sections 421, 422, 423 are completely and securely attached to the pantyhose 400, such as by sewing, knitting or weaving. By so integrally attaching the cushion sections 421, 422, 423 to the panty hose 400, stray particles are prevented from entering and ruining the fabric of the pantyhose 400. As such, the wear and tear on the fabric that is typically caused by removing and interchanging padding in prior art devices is avoided by the sock 400. The cushioning sections 421, 422, 423 stay securely in place under the wearer's foot and easily adjusts for a wide range of climatic conditions.

The panty hose 400 can be employed for general purpose and/or therapeutic applications. The panty hose 400 eliminates any need for a cushion/support insert typically positioned within a shoe. The cushioning material in the cushion sections 421, 422, 423 can be antimicrobial and/or hypoallergenic treated. The four layer construction of the panty hose 400 can be incorporated into other hosiery products, such as socks, footies, cushion socks and trouser socks. In an alternative embodiment, the cushioning material can be inserted into a waterproof fabric and cut, weaved, stitched, knitted and placed into the pantyhose.

A hosiery product and method of making same are described above. Various changes can be made to the invention without departing from its scope. The above description of the preferred embodiments and best mode of the invention are provided for the purpose of illustration only and not limitation—the invention being defined by the claims and equivalents thereof.

What is claimed is:

1. A hosiery product comprising:

an inner layer of hosiery material adapted to cover bottom and top surfaces of a wearer's foot;

an outer layer of reinforced hosiery material adapted to cover bottom and top surfaces of a wearer's foot;

an elevated cushion support layer comprising a cushioning material disposed between the inner layer of hosiery material and the outer layer of reinforced hosiery material, wherein the elevated cushion support layer is adapted to cushion a metatarsal ball region, an arch region, and a heel region of the bottom surface of the wearer's foot;

the elevated cushion support layer comprises a plurality of elevated circle cushions that increase in size from the lateral to the medial side of a wearer's foot and are connected to one another on at least one side of the plurality of elevated circle cushions;

the plurality of elevated cushions comprises at least one material from the group consisting of viscoelastic support gel, macro-gel activated support discs, memory foam, gel memory foam, or latex foam;

and, a padding layer located between the elevated cushion support layer and the outer layer of reinforced hosiery material which is adapted to support the bottom surface of a wearer's foot.

2. The hosiery product according to claim 1, wherein the elevated cushion support layer is permanently attached to the inner layer of hosiery material.

3. The hosiery product according to claim 1, wherein the elevated cushion support layer is attached by at least one attachment means selected from the group consisting of sewing, stitching, knitting, weaving and stamping.

4. The hosiery product according to claim 1, wherein the elevated cushion support layer comprises latex foam.

5. The hosiery product according to claim 1, wherein the inner layer of hosiery material and the outer layer of reinforced hosiery material comprise at least one material selected from the group consisting of nylon and spandex.

6. The hosiery product according to claim 1, wherein the padding layer is positioned to support the elevated cushion support layer.

7. The hosiery product according to claim 1, wherein the hosiery product is selected from the group consisting of a sock, a footie, a knee high and a pantyhose.

8. The hosiery product according to claim 7, wherein the sock is selected from the group consisting of a cushion sock and a trouser sock.

9. The hosiery product according to claim 1, wherein the elevated cushion support layer of the hosiery product is adapted to extend to the extremity of a user's toes in order to provide comfort to the entire foot of said user.

10. The hosiery product according to claim 9, wherein the elevated cushion support layer of the hosiery product is adapted to stop at the bend of the toes of the user.

* * * * *